US010961760B2

(12) United States Patent
Shetty et al.

(10) Patent No.: US 10,961,760 B2
(45) Date of Patent: Mar. 30, 2021

(54) DOOR CLOSER WITH BACKOUT PREVENTION

(71) Applicant: Schlage Lock Company LLC, Carmel, IN (US)

(72) Inventors: Adithya G. Shetty, Bangalore (IN); Jonah M. Pattar, Bangalore (IN); Colins V. Jacob, Bangalore (IN); Mitchell T. Barbon, Westfield, IN (US); David V. Toloday, Martinsville, IN (US); Paul Koeske, Fishers, IN (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

(21) Appl. No.: 16/271,184

(22) Filed: Feb. 8, 2019

(65) Prior Publication Data

US 2020/0256108 A1 Aug. 13, 2020

(51) Int. Cl.
*E05F 1/08* (2006.01)
*E05F 3/10* (2006.01)

(52) U.S. Cl.
CPC ..... *E05F 3/102* (2013.01); *E05Y 2900/132* (2013.01)

(58) Field of Classification Search
CPC . Y10T 16/577; Y10T 16/2804; Y10T 16/285; Y10T 16/293; Y10T 16/585;
(Continued)

(56) References Cited

U.S. PATENT DOCUMENTS 1,886,159 A * 11/1932 Brown ..... F22B 37/423 251/155
4,048,694 A 9/1977 Newman et al.
(Continued)

FOREIGN PATENT DOCUMENTS

EP 0467131 A1 * 1/1992 ..... E05F 3/223
EP 2905407 B1 * 11/2016 ..... F16K 35/00
(Continued)

OTHER PUBLICATIONS

International Search Report; International Searching Authority; International Application No. PCT/US2020/017472; dated Aug. 10, 2020; 3 pages.
(Continued)

*Primary Examiner* — Chuck Y Mah
(74) *Attorney, Agent, or Firm* — Taft Stettinius & Hollister LLP

(57) ABSTRACT

An exemplary door closer includes a housing defining a hydraulic chamber having a hydraulic fluid disposed therein. A pinion is rotatably mounted to the housing and extends into the hydraulic chamber. A piston is mounted for reciprocal movement within the housing, and defines a rack engaged with the pinion. The housing further defines an aperture in fluid communication with the hydraulic chamber. A regulating screw is rotatably mounted within the aperture such that rotation of the regulating screw in a first direction advances the regulating screw into the hydraulic chamber and such that rotation of the regulating screw in an opposite second direction withdraws the regulating screw away from the hydraulic chamber. A stop member is mounted in the aperture such that the stop member limits withdrawing movement of the regulating screw to thereby prevent leaking of the hydraulic fluid from the hydraulic chamber via the aperture.

16 Claims, 5 Drawing Sheets

(58) Field of Classification Search
CPC ..... Y10T 16/299; Y10T 16/286; Y10T 16/27; E05F 3/10; E05F 3/12; E05F 3/104; E05F 3/102; E05F 3/22; E05F 3/221; E05F 3/223; E05F 3/227; E05Y 2900/132
See application file for complete search history.

(56) References Cited

U.S. PATENT DOCUMENTS 4,378,612 A 4/1983 Beers
4,386,446 A * 6/1983 Zunkel ..... E05F 3/12 16/58
4,414,703 A 11/1983 Schnarr et al.
4,573,238 A * 3/1986 Phillips ..... E05F 3/102 137/513.5
4,660,250 A * 4/1987 Tillman ..... E05F 1/006 16/58
4,847,946 A * 7/1989 Nam ..... E05F 3/102 16/53
5,187,835 A * 2/1993 Lee ..... E05F 3/102 16/52
5,259,090 A * 11/1993 Fayngersh ..... E05F 3/102 16/52
5,301,776 A 4/1994 Beck
5,343,593 A * 9/1994 Fayngersh ..... E05F 3/102 16/52
5,502,874 A * 4/1996 Lucas ..... E05F 3/102 16/52
5,535,514 A 7/1996 Lucas
5,666,692 A * 9/1997 Toledo ..... E05F 3/104 16/51
6,282,750 B1 * 9/2001 Bishop ..... E05F 3/10 16/79
6,493,904 B1 * 12/2002 Chiang ..... E05F 3/104 16/56
8,181,311 B2 * 5/2012 Chiang ..... E05F 3/104 16/56
2013/0086771 A1 4/2013 Blockley

FOREIGN PATENT DOCUMENTS

GB 888854 A 2/1962
JP 2007298061 A 11/2007

OTHER PUBLICATIONS

Written Opinion of the International Searching Authority, International Searching Authority; International Application No. PCT/US2020/017472; dated Aug. 10, 2020; 6 pages.

* cited by examiner

DOOR CLOSER WITH BACKOUT PREVENTION

TECHNICAL FIELD

The present disclosure generally relates to door closers, and more particularly but not exclusively relates to hydraulic door closers.

BACKGROUND

Door closers are commonly installed to swinging doors to bias the door towards a closed position. Many such door closers include a piston that reciprocates within a housing, which is filled with a hydraulic fluid that resists the movement of the piston. The housing defines a flow passage through which the fluid flows as the piston reciprocates, and an adjustable regulation valve controls the rate of fluid flow through the passage to modulate the speed of the piston. The valve is typically screwed into the housing, and can be rotated in opposite directions to advance and withdraw the screw valve. However, it has been found that certain closers of this type suffer from drawbacks and limitations, such as those related to ease of adjustment. For example, if the screw valve is backed out too far, the hydraulic fluid will begin to leak from the passage, thereby causing the closer to fail. For these reasons among others, there remains a need for further improvements in this technological field.

SUMMARY

An exemplary door closer includes a housing defining a hydraulic chamber having a hydraulic fluid disposed therein. A pinion is rotatably mounted to the housing and extends into the hydraulic chamber. A piston is mounted for reciprocal movement within the housing, and defines a rack engaged with the pinion. The housing further defines an aperture in fluid communication with the hydraulic chamber. A regulating screw is rotatably mounted within the aperture such that rotation of the regulating screw in a first direction advances the regulating screw into the hydraulic chamber and such that rotation of the regulating screw in an opposite second direction withdraws the regulating screw away from the hydraulic chamber. A stop member is mounted in the aperture such that the stop member limits withdrawing movement of the regulating screw to thereby prevent leaking of the hydraulic fluid from the hydraulic chamber via the aperture. Further embodiments, forms, features, and aspects of the present application shall become apparent from the description and figures provided herewith.

DETAILED DESCRIPTION OF ILLUSTRATIVE EMBODIMENTS

Figure 1:
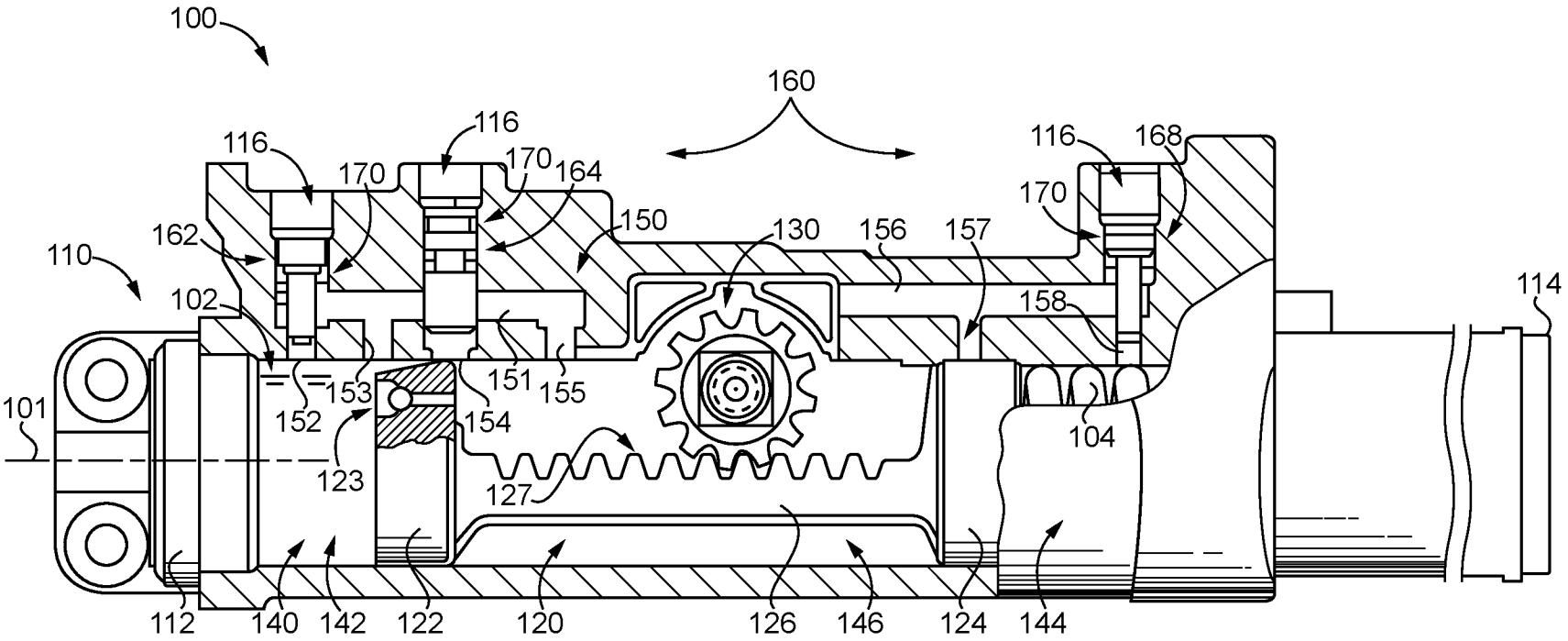
FIG. 1 is a partial cutaway illustration of a door closer according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may be omitted or may be combined with other features.

With reference to FIG. 1, illustrated therein is a door closer 100 according to certain embodiments. The closer 100 extends along a longitudinal axis 101 defining a proximal direction (to the left in FIG. 1) and an opposite distal direction (to the right in FIG. 1). The closer 100 generally includes a housing 110, a piston 120 mounted for reciprocal movement within the housing, and a pinion 130 rotatably mounted to the housing 110 and engaged with the piston 120. The housing 110 defines a hydraulic chamber 140 including a plurality of sub-chambers and a plurality of passages 150 defining paths of fluid communication between the sub-chambers. The hydraulic chamber 140 is filled with a hydraulic fluid 102. The closer 100 further includes a valve assembly 160 including a plurality of valves 170 that regulate the flow of the hydraulic fluid 102 through the passages 150.

The housing 110 defines the hydraulic chamber 140, and is filled with the hydraulic fluid 102. The housing 110 includes a proximal end cap 112 enclosing a proximal end of the hydraulic chamber 140 and a distal end cap 114 enclosing a distal end of the hydraulic chamber 140. Also disposed in the housing 110 is a spring 104, which is engaged with the piston 120 and biases the piston 120 in the proximal direction. The housing 110 further defines a plurality of apertures 116, each of which is in fluid communication with one of the passages 150 and houses a corresponding and respective one of the valves 170.

The piston 120 is mounted for reciprocal movement within the hydraulic chamber 140, and generally includes a proximal wall 122, a distal wall 124, and a body portion 126 extending between and connecting the proximal wall 122 and the distal wall 124. As described herein, the proximal wall 122 and the distal wall 124 are closely engaged with the inner wall of the housing 110 and separate the hydraulic chamber 140 into three sub-chambers. The proximal wall 122 includes a check valve 123, and the body portion 126 defines a rack gear 127 that is engaged with the pinion 130.

The pinion 130 is rotatably mounted to the housing 110 and is engaged with the rack gear 127 such that rotation of the pinion 130 is correlated with the reciprocal movement of the piston 120. A door control arm is mounted to the pinion 130 and is engaged with either the door or the doorframe such that swinging movement of the door is correlated with rotation of the pinion 130, linear movement of the piston 120, and compression/extension of the spring 104. For example, opening movement of the door is correlated with rotation of the pinion 130 in a door-opening direction (counter-clockwise in FIG. 1), distal movement of the piston 120, and compression of the spring 104. Conversely, closing movement of the door is correlated with rotation of the pinion 130 in a door-closing direction (clockwise in FIG. 1), proximal movement of the piston 120, and expansion of the spring 104.

The hydraulic chamber 140 is divided into three portions or sub-chambers by the piston 120. More particularly, a proximal chamber 142 is defined between the proximal wall 122 and the proximal end cap 112, a distal chamber 144 is defined between the distal wall 124 and the distal end cap 114, and an intermediate chamber 146 is defined between the proximal wall 122 and the distal wall 124. As will be appreciated, the reciprocal movement of the piston 120 causes expansion and contraction of the proximal and distal chambers 142, 144, while the intermediate chamber 146 remains of a substantially constant volume. In certain forms, the hydraulic chamber 140 may be considered to include the passages 150.

The passages 150 include a proximal passage 151 including branches 152-156, and a distal passage 157 including branches 158, 159. The proximal passage 151 forms a fluid connection between the proximal chamber 142 and the intermediate chamber 156, and the distal passage 157 forms a fluid connection between the intermediate chamber 156 and the distal chamber 146. The branches 152-155, 157, 158 form selective paths of fluid communication between the various portions of the hydraulic chamber 140 based upon the position of the piston 120, and the valve assembly 160 regulates the flow of hydraulic fluid 102 through the passages 150. As described herein, the effective cross-sectional area of the passages 150 depends upon a number of factors, including the state of the valve assembly 160 and which of the branches are connected to which of the chambers.

The valve assembly 160 includes a plurality of regulating valves 170, including a latch speed regulating valve 162, a main speed regulating valve 164, and a backcheck speed regulating valve 168, each of which is mounted in a corresponding and respective aperture 116 and extends into a corresponding and respective one of the branches 152, 154, 158.

Figure 3:
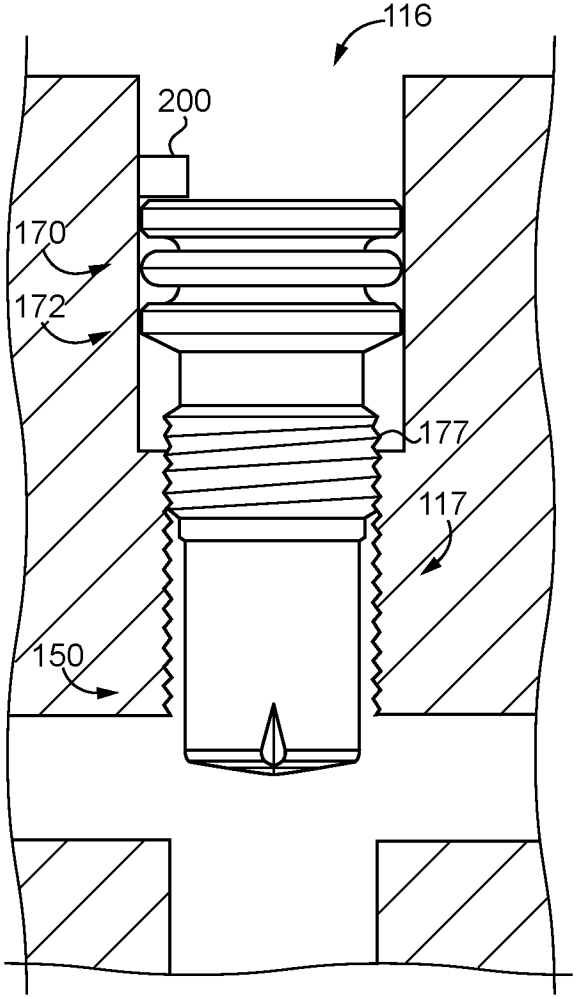
FIG. 3 illustrates the regulating screw in a withdrawn stop position, with a stop member preventing further withdrawing movement of the regulating screw.
Figure 2:
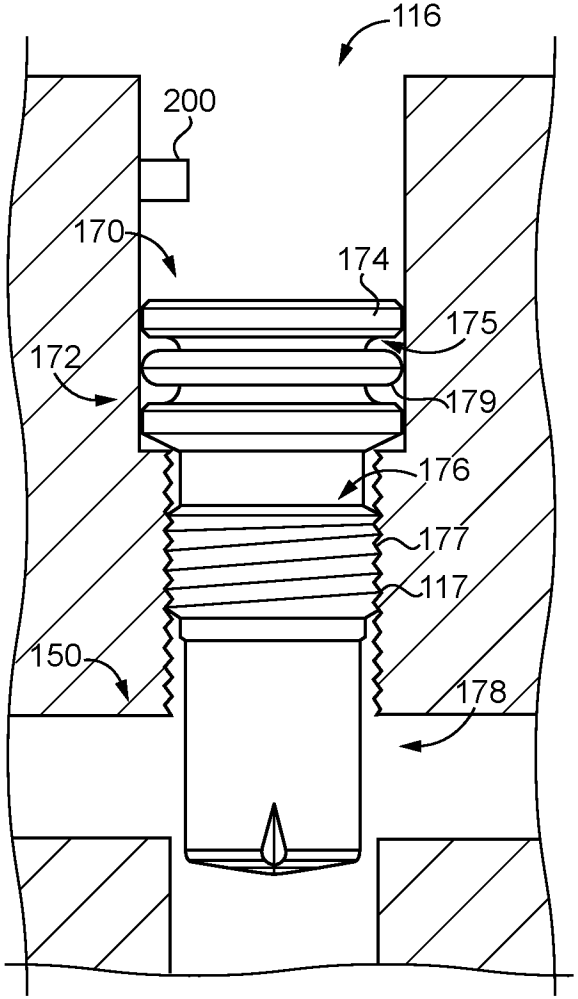
FIG. 2 illustrates a regulating screw of the door closer in an advanced position within an aperture.

With additional reference to FIGS. 2 and 3, each regulating valve 170 is provided in the form of a regulating screw 172. Each screw 172 is mounted in the corresponding aperture 116 and includes a head 174, a threaded portion 176, and a stem 178 extending into one of the passageways 150. The head 174 includes an annular channel 175 in which a seal such as an O-ring 179 is seated. The head 174 is configured to engage a tool by which the screw 172 can be rotated, such as a screwdriver or a hex key. The threaded portion 176 has external threads 177 that engage with internal threads 117 of the aperture 116 such that rotation of the screw 172 in a first direction advances the screw towards an advanced position (FIG. 2), and rotation of the screw 172 in an opposite second direction withdraws the screw 172 toward a withdrawn position (FIG. 3). In the illustrated form, the threads 117, 177 remain engaged with one another in both the advanced position and the withdrawn position. As described herein, the closer 100 further includes a stop member 200 configured to prevent withdrawal of the screw 172 beyond the withdrawn position such that the withdrawn position is also a stop position.

FIG. 1 illustrates the closer with the piston 120 in a position corresponding to the main swing zone of the door. In this state, the proximal chamber 142 is in fluid communication with the intermediate chamber 146 via the first passage 151. More particularly, the branches 152, 153 are open to the proximal chamber 142, and the branches 154, 155 are open to the intermediate chamber 146. During opening movement of the door, the piston 120 moves in the distal direction, thereby expanding the proximal chamber 142 and contracting the distal chamber 144. As a result, fluid 102 flows from the distal chamber 144 into the intermediate chamber 146 via the distal passage 157. Fluid 102 also flows the intermediate chamber 146 to the proximal chamber 142 via the check valve 123 and the proximal passage 151. During closing movement of the door, the piston 120 moves in the proximal direction, thereby contracting the proximal chamber 142 and expanding the distal chamber 144. As a result, fluid 102 flows from the proximal chamber 142 into the intermediate chamber 146 via the proximal passage 151, and flows from the intermediate chamber 146 into the distal chamber 144 via the distal passage 157.

As will be appreciated, the rate of fluid flow through the passages 150 is correlated with the movement speed of the piston 120, and thus with the movement speed of the door. The rate of fluid flow through the passages 150 depends upon a number of factors, including the effective cross-sectional area of the passage. Additionally, the effective cross-sectional area of each passage can be altered by adjustment of the valve assembly 160. For example, advancing the screw 172 of the main speed adjustment valve 164 reduces the effective cross-sectional area of the proximal passage 151 at the branch 154, thereby reducing the closing speed of the door in the main swing zone. As another example, withdrawing the screw 172 of the latch speed adjustment valve 162 increases the effective cross-sectional area of the proximal passage 151 at the branch 152, thereby increasing the closing speed of the door in the latching zone.

Due to the fact that the apertures 116 are connected with the passageways 150, the hydraulic fluid 102 left unchecked would be able to leak from the hydraulic chamber 140 via the apertures 116. When the screw 172 is threaded into the aperture 116, such leakage is prevented by the engagement of the threads 117, 177 and the seal provided by the O-ring 179. If the screw 172 were to be withdrawn beyond the withdrawn position and/or removed from the aperture 116, leakage may occur. However, such an event is discouraged by the stop member 200, which limits withdrawing movement of the screw 172 to thereby prevent leaking of the hydraulic fluid 102 via the aperture 116. Certain illustrative examples of the stop member 200 will now be described with reference to FIGS. 4-9.

Figure 4:
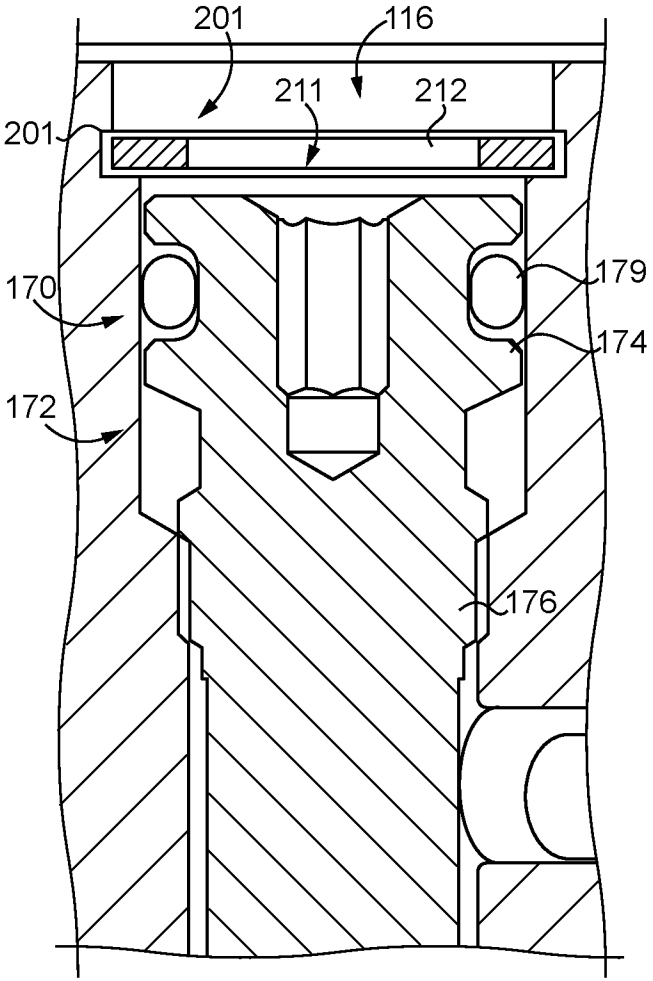
FIG. 4 is a cross-sectional illustration of a stop member according to certain embodiments installed in the aperture near the regulating screw.

With reference to FIG. 4, illustrated therein is a stop member 212 in the form of a retention ring having a central opening 211 through which a tool can be inserted to manipulate the valve 170. In the illustrated embodiment, the aperture 116 includes an annular groove 201 in which the retention ring 212 is seated. The dimensions of the groove 201 and the retention ring 212 are selected such that the retention ring 212 projects into the aperture 116 by a sufficient distance to prevent withdrawal of the screw 172 beyond the withdrawn stop position. The retention ring 212 may, for example, be provided in the form of a circlip or a C-clip.

Figure 5:
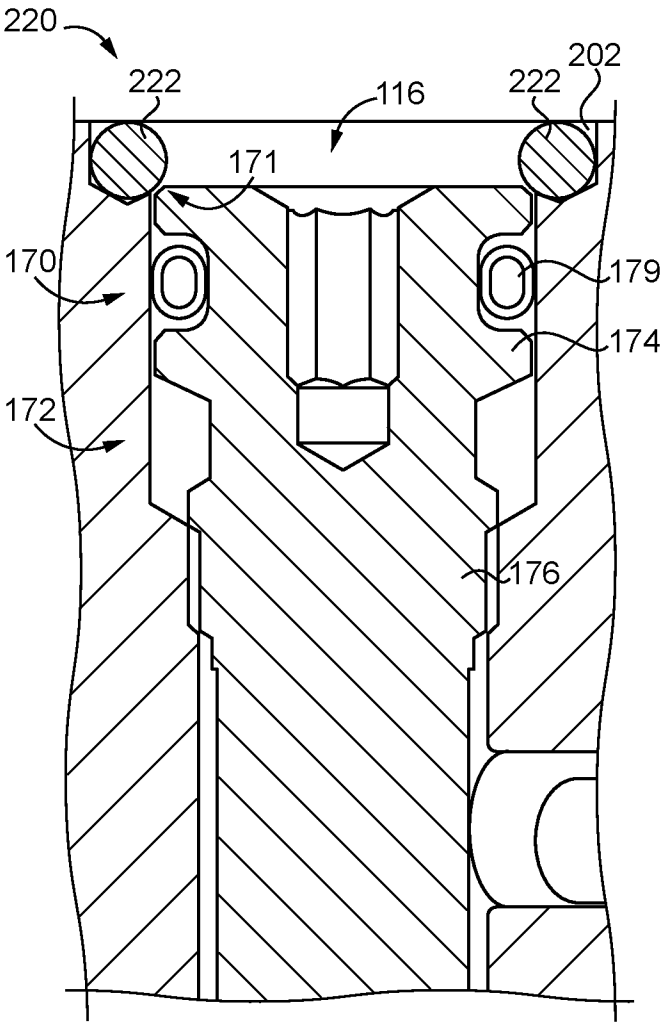
FIG. 5 is a cross-sectional illustration of a stop member according to certain embodiments installed in the aperture near the regulating screw.

With reference to FIG. 5, illustrated therein is a stop member 220 including a pair of blocking spheres 222. In the illustrated embodiment, the aperture 116 includes a pair of recesses 202 in which the spheres 222 are seated. The spheres 222 may be staked into the recesses 202. The dimensions of the recesses 202 and the spheres 222 are selected such that the spheres 222 project into the aperture 116 by a sufficient distance to prevent withdrawal of the screw 172 beyond the withdrawn position. In certain forms, the head 174 of the screw 172 may include a radially outer chamfer 171. In such embodiments, the chamfer 171 may engage the spheres 222 such that the primary force acting on the spheres 222 urges the spheres 222 in the radially outward direction (as opposed to the withdrawing direction) thereby increasing the holding force provided by the stop member 220.

Figure 6:
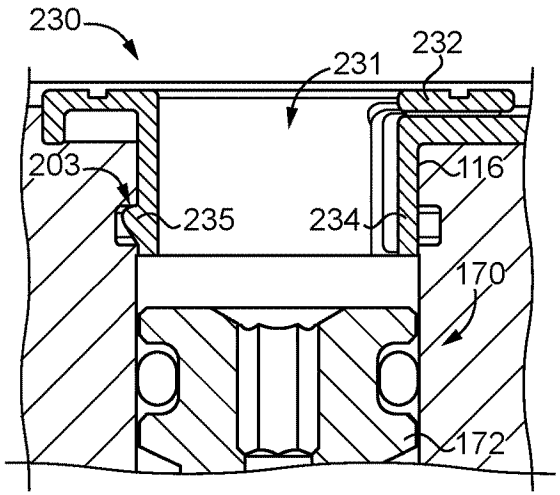
FIG. 6 is a perspective illustration of a stop member according to certain embodiments.
Figure 7:
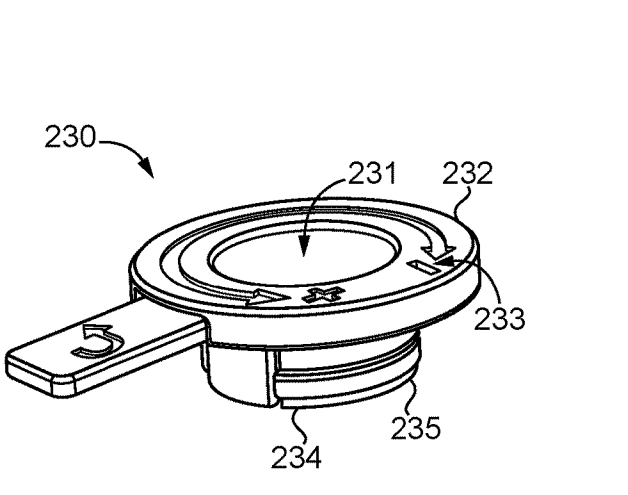
FIG. 7 is a cross-sectional illustration of the stop member illustrated in FIG. 6 installed in the aperture near the regulating screw.

With reference to FIGS. 6 and 7, illustrated therein is a stop member 230 including a central opening 231 through which a tool can be inserted to manipulate the valve 170, a flange 232 surrounding the opening 231, and an engagement member 234 extending from the flange 232. The engagement member 232 is generally C-shaped in cross-section, and includes a ridge 235 that engages a groove 203 formed in the aperture 116 to thereby secure the stop member 230 to the aperture 116. The dimensions of the stop member 230 are selected such that when the stop member 230 is secured to the aperture 116, the engagement member 234 is operable to prevent withdrawing movement of the screw 172 beyond the withdrawn stop position. In the illustrated form, the flange 232 also includes visual indicia 233 indicating that rotating the regulating screw 172 in one direction advances of the regulating screw 172 and/or that rotating the regulating screw 172 in an opposite second direction withdraws of the regulating screw 172.

Figure 8:
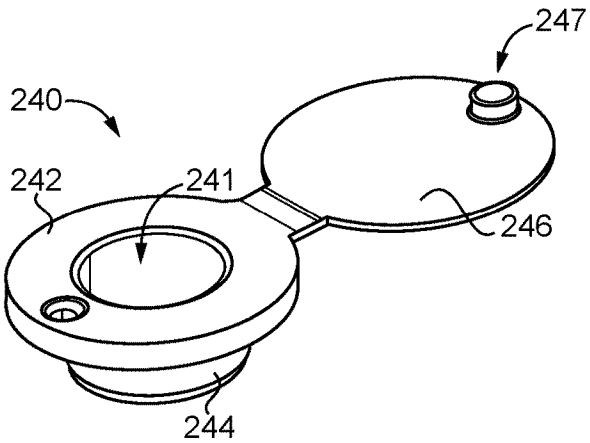
FIG. 8 is a perspective illustration of a stop member according to certain embodiments.
Figure 9:
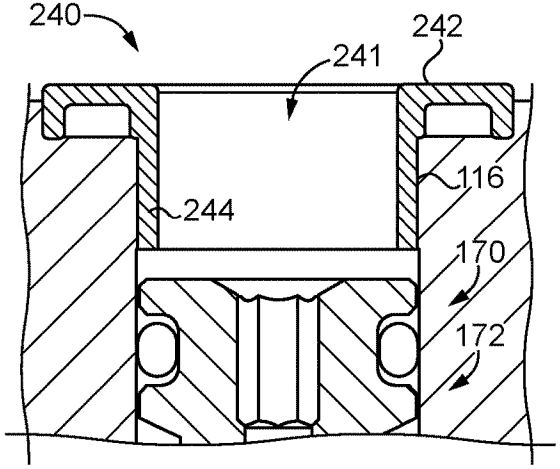
FIG. 9 is a cross-sectional illustration of the stop member illustrated in FIG. 8 installed in the aperture near the regulating screw.

With reference to FIGS. 8 and 9, illustrated therein is a stop member 240 including a central opening 241 through which a tool can be inserted to manipulate the valve 170, a flange 242 surrounding the opening 241, an engagement member 244 extending from the flange 244, and a cap 246 hingedly connected to the flange 242. The engagement member 242 is generally annular, and is press-fit into the aperture 116. The dimensions of the stop member 240 are selected such that when the stop member 240 is secured to the aperture 116, the engagement member 244 is operable to prevent withdrawing movement of the screw 172 beyond the withdrawn stop position. The cap 246 includes a snap 247 operable to selectively retain the cap 246 in a closed position in which the cap 246 covers the aperture 116. In certain forms, the cap 246 may include visual indicia indicating which of the valves 170 is located within the aperture 116, thereby facilitating the adjustment process.

Figure 10:
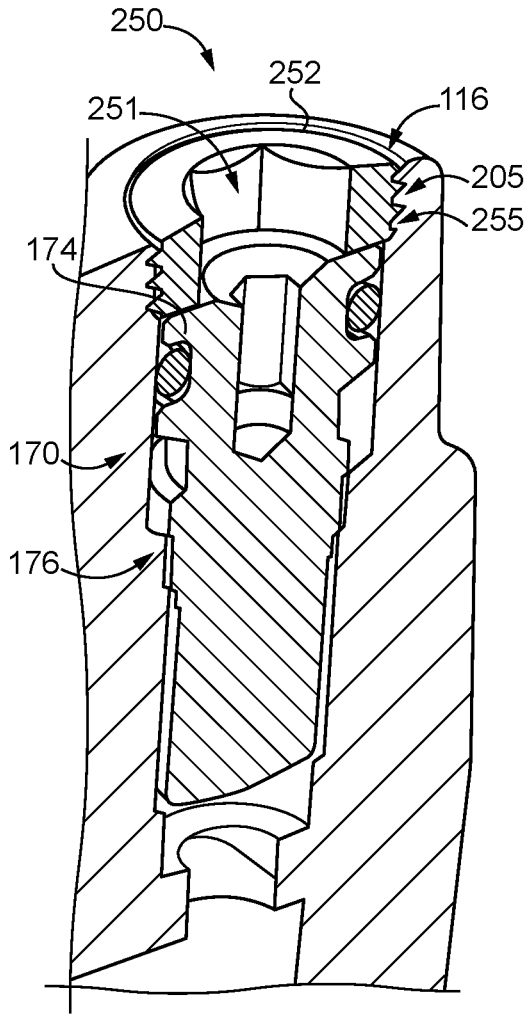
FIG. 10 is a cross-sectional illustration of a stop member according to certain embodiments installed in the aperture near the regulating screw.

With reference to FIG. 10, illustrated therein is a stop member 250 in the form of a threaded retention ring 252 having a central opening 251 through which a tool can be inserted to manipulate the valve 170. In the illustrated embodiment, the aperture 116 includes internal threads 205 that threadedly engage external threads 255 of the stop member 250. Like the head of the valve 170, the central opening 251 is configured to engage a tool such as a hex key by which the retention ring 252 can be rotated. The diameter of the opening 251 is greater than the diameter of the opening in the head 174 such that using a tool to rotate the valve 170 does not cause a corresponding rotation of the stop member 250. In certain forms, the direction of the threading 255 of the stop member 250 and the direction of the threading of the threaded portion 176 are opposite one another such that a rotation that would cause the valve 170 to move in the withdrawing direction would cause the stop member 250 to move in the advancing direction. As a result, even when the stop member 250 is frictionally engaged with the head 174, rotation of the valve 170 to withdrawn the valve 170 does not cause the stop member 170 to move in the withdrawing direction, thereby preventing withdrawing movement of the valve 170 beyond the withdrawn position.

As is evident from the foregoing, each of the stop members described herein is operable to prevent withdrawing movement of the screw 172 beyond the withdrawn stop position, and thereby prevents leaking of the hydraulic fluid from the aperture 116. Each of the illustrated stop members also permits a tool to be inserted into the aperture 116 for manipulation of the regulating screw 172 without requiring removal of the stop member. The capped stop member 240 also allows the valve 170 to be obscured to discourage tampering.

Those skilled in the art will readily appreciate that the stop members described herein can be used in combination with each and any of the regulating valves 170, or in combination with door closer regulation screws not specifically described and illustrated herein. Furthermore, while one form of hydraulic door closer 100 has been provided for purposes of illustration, it is to be appreciated that the embodiments described herein may be utilized in door closers of other forms and formats.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A hydraulic door closer, comprising:

a housing defining a hydraulic chamber having a hydraulic fluid disposed therein, wherein the housing further defines an aperture in fluid communication with the hydraulic chamber;

a pinion rotatably mounted to the housing and extending into the hydraulic chamber;

a piston mounted for reciprocal movement within the housing, wherein the piston defines a rack engaged with the pinion such that rotation of the pinion is correlated with reciprocal motion of the piston;

a regulating screw rotatably mounted within the aperture such that rotation of the regulating screw in a first direction advances the regulating screw toward the hydraulic chamber and rotation of the regulating screw in an opposite second direction withdraws the regulating screw away from the hydraulic chamber; and a stop member mounted in the aperture such that the stop member limits withdrawing movement of the regulating screw to thereby prevent leaking of the hydraulic fluid from the hydraulic chamber via the aperture; and wherein the aperture includes an annular groove and the stop member includes a ridge seated in the annular groove, and wherein the stop member further includes a flange positioned outside the aperture.

2. The hydraulic door closer of claim 1, further comprising a seal mounted to the regulating screw, and wherein the seal prevents leaking of the hydraulic fluid from the hydraulic chamber when the regulating screw is in an advanced position.

3. The hydraulic door closer of claim 1, wherein the regulating screw has an advanced position and a withdrawn position;

wherein the regulating screw is threadedly engaged with the housing in each of the advanced position and the withdrawn position; and wherein the stop member prevents withdrawing movement of the regulating screw beyond the withdrawn position.

4. The hydraulic door closer of claim 1, wherein the stop member is press-fit into the aperture.

5. The hydraulic door closer of claim 1, wherein the hydraulic chamber includes a first sub-chamber, a second sub-chamber separated from the first sub-chamber by a portion of the piston, and a passageway connecting the first sub-chamber and the second sub-chamber; and wherein the regulating screw extends into the passageway when in an advanced position.

6. The hydraulic door closer of claim 1, wherein the stop member directly engages the regulating screw to discourage removal of the regulating screw from the aperture.

7. The hydraulic door closer of claim 1, wherein the regulating screw is positioned entirely within the aperture and does not extend outside of the aperture.

8. The hydraulic door closer of claim 1, wherein a head of the regulating screw is configured to engage a tool, and wherein the stop member defines an opening in the aperture sized and shaped to receive the tool to thereby permit passage of the tool through the opening in the stop member and into the aperture to engage the head and permit manipulation of the regulating screw without requiring removal of the stop member.

9. A door closer, comprising:

a housing defining a hydraulic chamber having a hydraulic fluid disposed therein, wherein the hydraulic chamber includes a first sub-chamber, a second sub-chamber, and a passage connecting the first sub-chamber and the second sub-chamber, and wherein the housing further defines an aperture in fluid communication with the passage;

a pinion rotatably mounted to the housing and extending into the hydraulic chamber;

a piston mounted for reciprocal movement within the housing, wherein the piston defines a rack engaged with the pinion such that rotation of the pinion is correlated with reciprocal motion of the piston, and wherein the piston includes a wall separating the first sub-chamber from the second sub-chamber;

a regulating valve mounted within the aperture for movement between an advanced position and a withdrawn position to adjust an effective cross-sectional area of the passage; and a stop member mounted in the aperture, wherein the stop member is configured to prevent withdrawing movement of the regulating valve beyond the withdrawn position;

wherein the stop member comprises a flange and an engagement member extending from the flange; and wherein the flange is seated within the aperture.

10. The door closer of claim 9, wherein the aperture further comprises a groove; and wherein the engagement member includes a ridge seated in the groove.

11. The door closer of claim 9, wherein the engagement member is C-shaped.

12. The door closer of claim 9, wherein the engagement member is annular.

13. The door closer of claim 9, wherein the flange further comprises visual indicia indicating that rotation of the regulating screw in the first direction advances the regulating screw and/or that rotation of the regulating screw in the second direction withdraws the regulating screw.

14. The door closer of claim 9, wherein the stop member further includes a cap hingedly connected to the flange.

15. The door closer of claim 14, wherein the stop member further comprises a snap operable to selectively retain the cap in a closed position in which the cap covers the aperture.

16. The door closer of claim 9, wherein the stop member is threaded into the aperture.

* * * * *